US005618219A

United States Patent [19]

Simone et al.

[11] Patent Number: 5,618,219

[45] Date of Patent: Apr. 8, 1997

[54] REMOTE CONTROL TOY VEHICLE WITH DRIVEN JUMPER

[75] Inventors: Dean C. Simone, Portola Valley; Rand W. Siegfried, Los Altos, both of Calif.; Gerald M. Rodmaker, Cincinatti, Ohio

[73] Assignee: Hasbro, Inc., Pawtucket, R.I.

[21] Appl. No.: 577,299

[22] Filed: Dec. 22, 1995

[51] Int. Cl.[6] ..... A63H 30/04; A63H 17/00; A63H 17/26

[52] U.S. Cl. ..... 446/456; 446/437; 446/466

[58] Field of Search ..... 446/454, 456, 446/431, 437, 441, 457, 466, 470, 471, 479; 180/199, 203, 8.1, 8.3; 280/43.14, 43.17, 43.24, 763.1

[56] References Cited

U.S. PATENT DOCUMENTS

| | | | |
|---|---|---|---|
| 784,992 | 3/1905 | Dimmick | 280/43.24 |
| 2,146,665 | 2/1939 | Wood | 446/437 X |
| 3,574,267 | 4/1971 | Schorsch | 446/431 X |
| 4,457,101 | 7/1984 | Matsushiro . | |
| 4,466,214 | 8/1984 | Kulesza et al. | 446/437 |
| 4,556,397 | 12/1985 | Arad et al. . | |
| 4,666,420 | 5/1987 | Nagano | 446/456 X |
| 4,700,798 | 10/1987 | Johansson et al. | 280/43.23 X |
| 4,702,720 | 10/1987 | Konta et al. . | |
| 4,705,487 | 11/1987 | Ishimoto . | |
| 4,781,649 | 11/1988 | Nagano . | |
| 4,892,503 | 1/1990 | Kumazawa . | |
| 4,894,042 | 1/1990 | Kamikawa . | |
| 4,943,256 | 7/1990 | Symons . | |
| 5,019,009 | 5/1991 | Chao-Chin et al. . | |
| 5,259,808 | 11/1993 | Garr . | |
| 5,322,469 | 6/1994 | Tilbor | 446/466 X |
| 5,334,075 | 8/1994 | Kakizaki et al. . | |
| 5,364,300 | 11/1994 | Jow . | |

FOREIGN PATENT DOCUMENTS

| | | | |
|---|---|---|---|
| 270725 | 9/1950 | Switzerland | 180/203 |
| 649102 | 1/1951 | United Kingdom | 180/203 |
| 2033766 | 5/1980 | United Kingdom | 446/441 |
| 2204842 | 11/1988 | United Kingdom | 180/199 |

*Primary Examiner*—Robert A. Hafer
*Assistant Examiner*—D. Neal Muir
*Attorney, Agent, or Firm*—Fish & Richardson P.C.

[57] ABSTRACT

A vehicle includes cam structure mounted on the vehicle constructed and arranged to have a first at-rest position and a second lift-initiating position that causes the vehicle when moving to jump, and at least one motor mounted on the vehicle for driving the vehicle and actuating the cam structure from the first at-rest position to the second lift-initiating position.

22 Claims, 7 Drawing Sheets

REMOTE CONTROL TOY VEHICLE WITH DRIVEN JUMPER

BACKGROUND OF THE INVENTION

The present invention relates in general to vehicles and more particularly concerns novel apparatus and techniques for vehicle jumping.

It is an important object of this invention to provide vehicle jumping.

SUMMARY OF THE INVENTION

According to the invention, a remote controlled vehicle system includes a remote transmitter controller for providing control signals, a vehicle including a receiver and decoder responsive to the control signals for providing decoded control signals, cam structure mounted on the vehicle constructed and arranged to have a first at-rest position and a second lift-initiating position that causes the vehicle when moving to jump, and at least one motor mounted on the vehicle responsive to selected ones of the decoded control signals for driving the vehicle and actuating the cam from the first at-rest position to the second lift-initiating position. The cam structure may include at least one rotatably supported idle wheel for contacting a travel surface when the cam is in the first at-rest position. There may be a cam axle intercoupling the motor and cam structure, and a cam arm having a first end connected to the cam axle and a second end connected to the cam structure. The cam structure may be pivotally connected to the second end for free rotation about a second end axis. A spring may be coupled to the cam axle for normally holding the cam structure in the first at-rest position. There may be a stop bar structure limiting the range of angular displacement of the cam axle between first and second predetermined limit angles. The cam structure may include circumferential strip structure for contacting a travel surface characterized by a coefficient of friction sufficiently high to prevent sliding movement between the travel surface and portions of the strip structure in contact therewith during rotation of the cam structure.

Numerous other features, objects and advantages of the invention will become apparent from the following detailed description when read in connection with the accompanying drawings in which:

DETAILED DESCRIPTION

Figure 1:
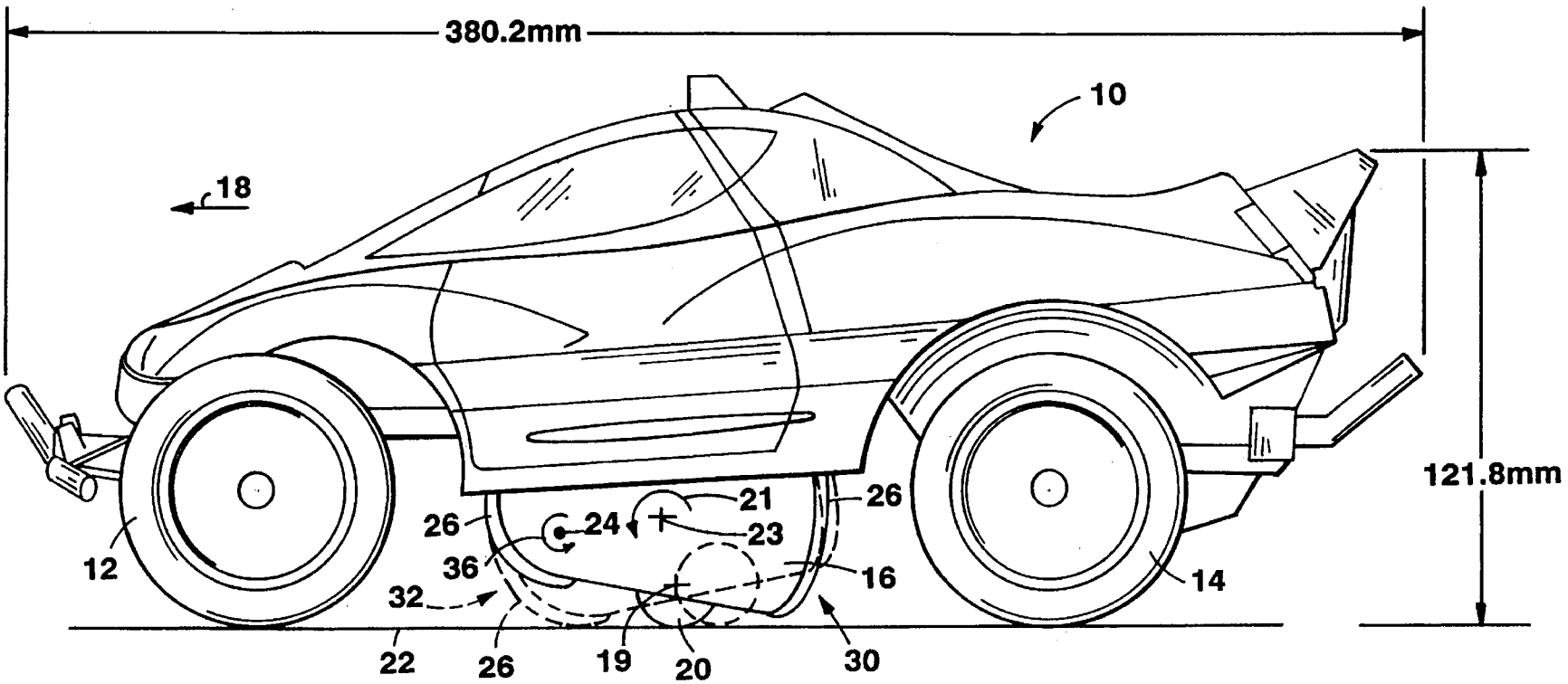
FIG. 1 is a side view of a jumping toy vehicle with jumping mechanism according to the invention.

With reference now to the drawings and more particularly FIG. 1 thereof, there is shown a side view of a jumping toy vehicle 10 including front and rear wheels 12 and 14, respectively, for normally rollably supporting vehicle 10 on a travel surface 22 coextensive with a bottom plane tangential to the bottommost portions of said wheels 12 and 14 and left cam 16 (only the wheels and cam on the left side of the vehicle being shown). Left cam 16 and right cam 16' (not shown) are identical mirror images, and only one cam is described in detail.

Cam 16 is positioned in FIG. 1 in an at-rest, non-jumping position with cam 16 entirely above the bottom plane coextensive with travel surface 22. With cam 16 in the at-rest position, an idle wheel 20 is in contact with the travel surface 22. Idle wheel 20 freely rotates about an axle 19. The idle wheel prevents cam 16 from rotating in a clockwise direction (as viewed in FIG. 1) which would result in undesirable dragging of the cam on the travel surface.

Figure 4:
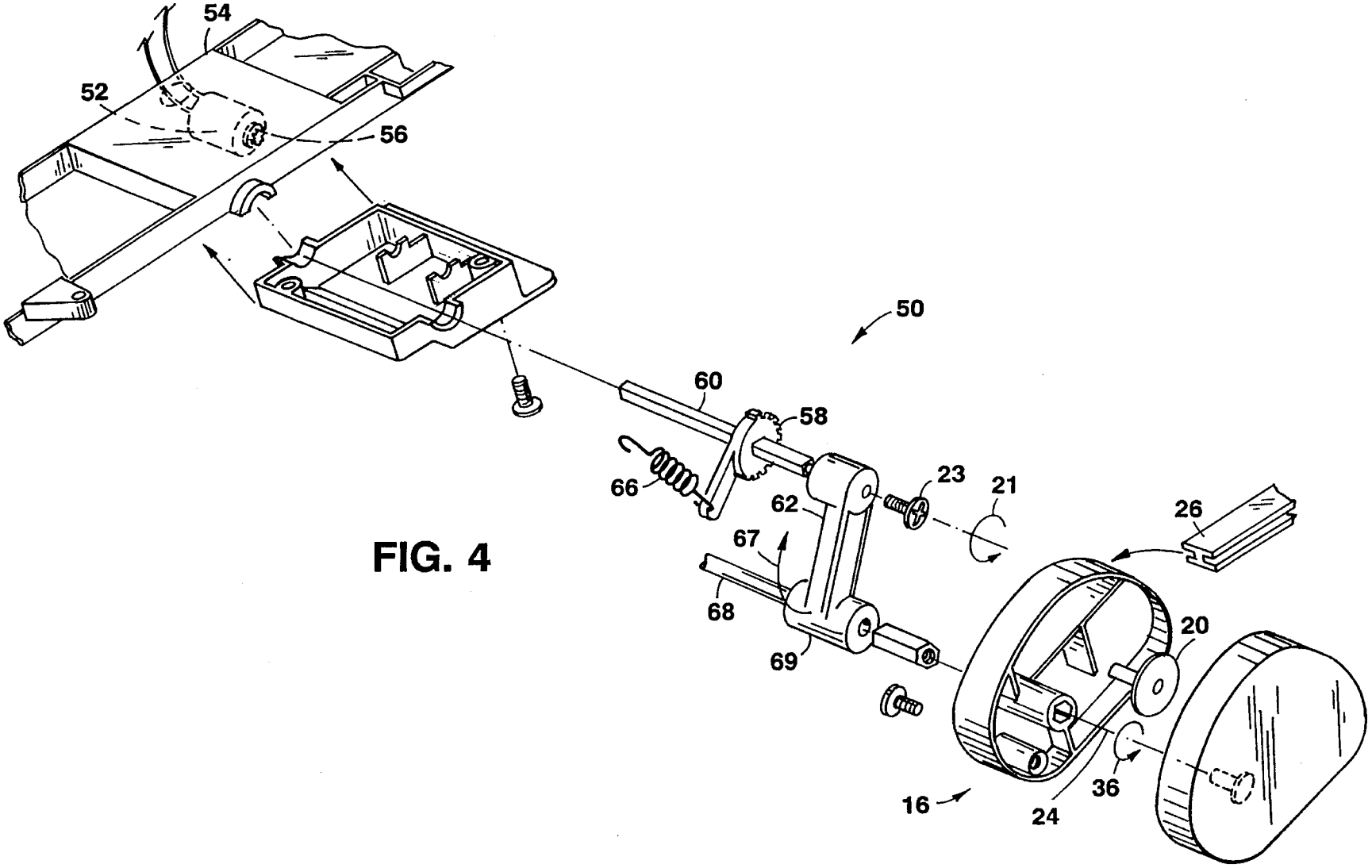
FIG. 4 is an exploded view showing the jumping mechanism for actuating a cam.

Vehicle 10 is mechanized, as described below, to lower cam 16 by rotating it in a counter-clockwise direction, indicated by arrow 21, about a first axis 23. Axis 23 is in a fixed position relative to vehicle chassis 54 (FIG. 4). The rotative action indicated by arrow 21 moves cam 16 from its at-rest position 30 to position 32 (shown in dashed lines) in which rubber tire 26 of cam 16 contacts the travel surface 22. With vehicle 10 traveling forward, in the direction indicated by arrow 18, once strip 26 contacts travel surface 22, the frictional force between strip 26 and travel surface 22 causes cam 16 to continue rotating counter-clockwise about first axis 23 (until a stop surface is contacted, as described below) and to also rotate counter-clockwise about a second axis 24 in a direction indicated by arrow 36.

Figure 2:
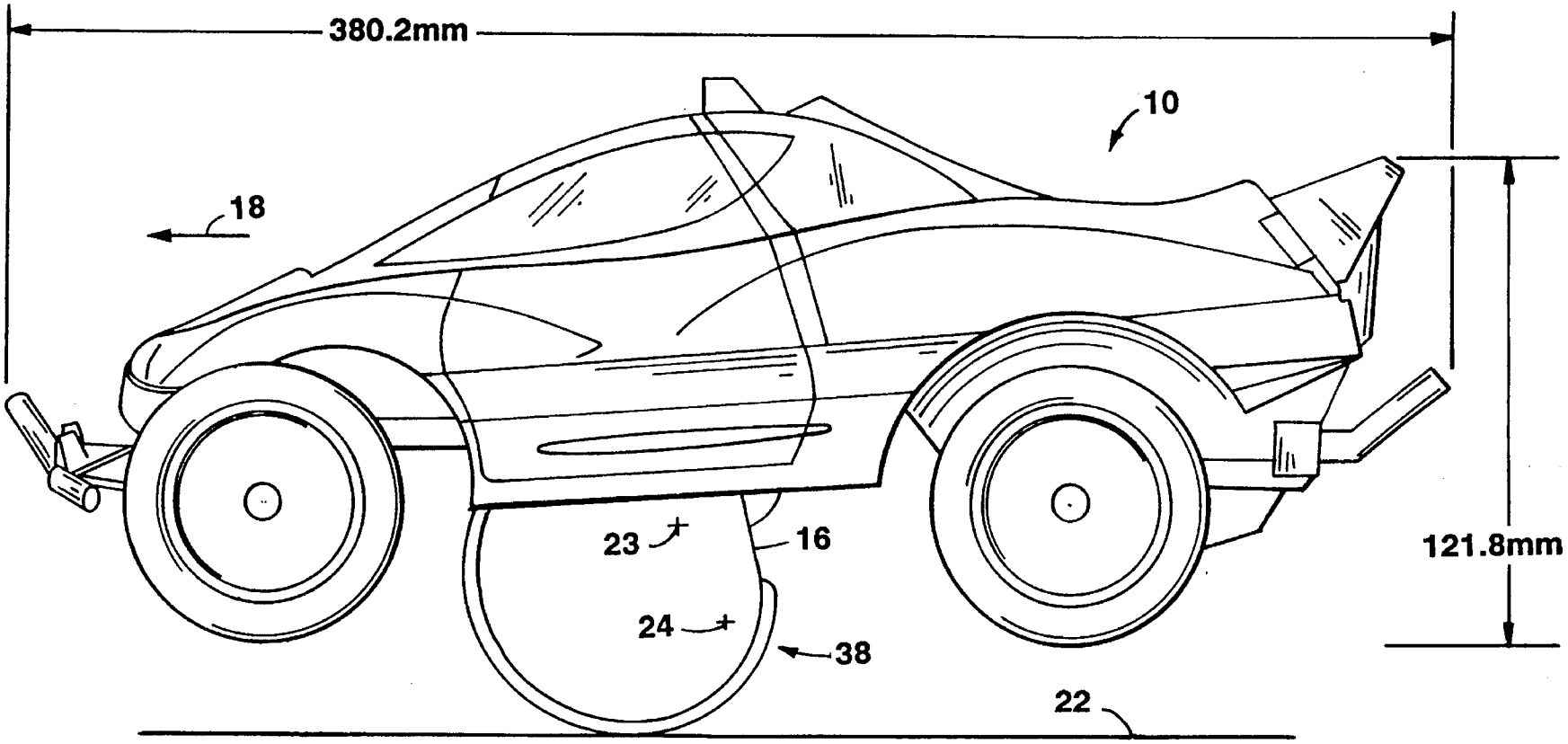
FIG. 2 is a side view of the jumping toy vehicle of FIG. 1 shown with the wheels elevated above the travel surface.
Figure 3:
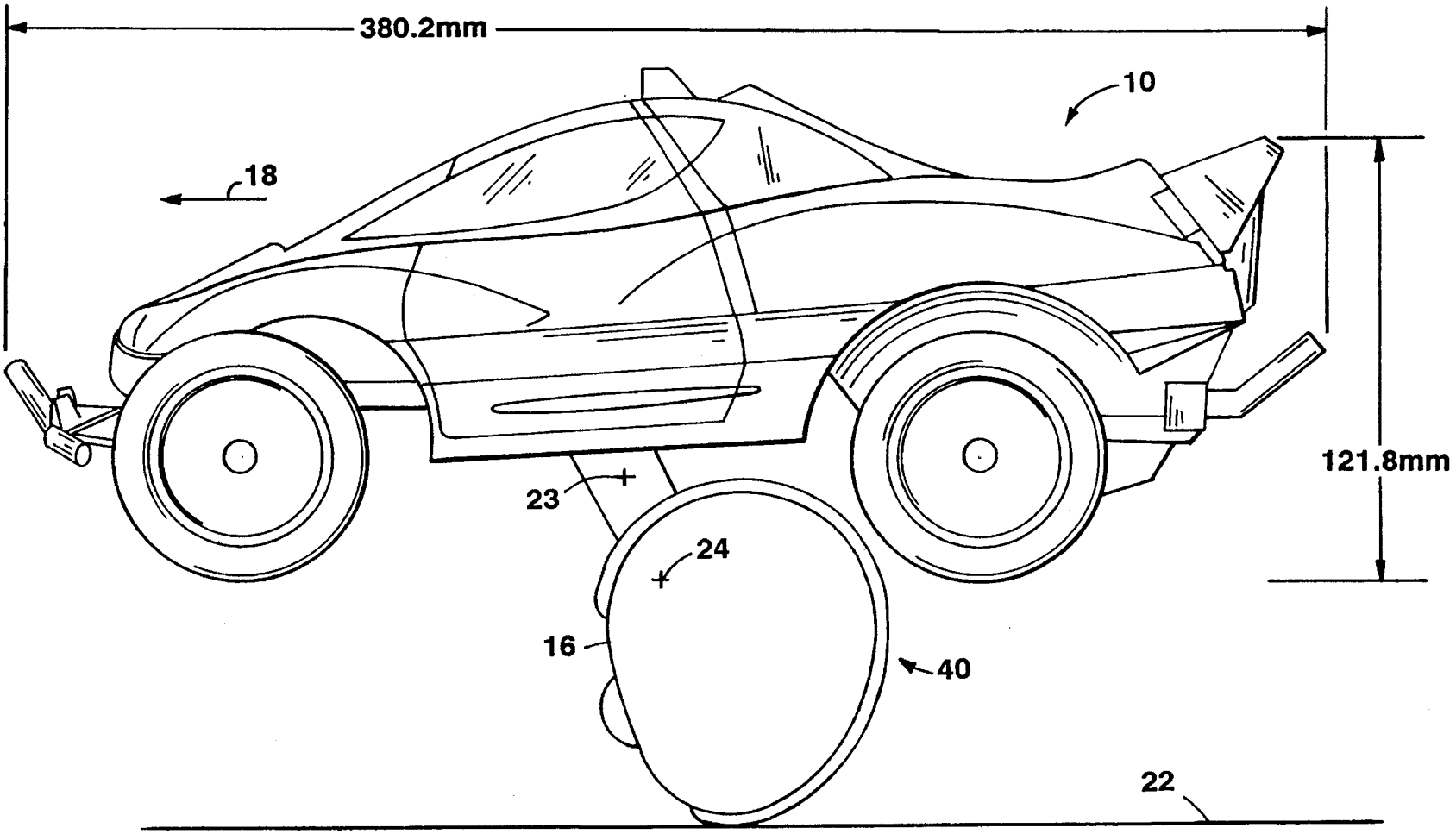
FIG. 3 is a side view of the jumping toy vehicle of FIG. 1 shown as the jumping toy vehicle leaves the travel surface.

Referring to FIGS. 2 and 3, the successive positions 38 and 40 of cam 16 are shown during counterclockwise rotation thereof. The entire vehicle, including cams 16, 16' leave surface 22 as the cams reach position 40 with a significant portion of cam 16 below the bottom plane and cam 16 in contact with travel surface 22 with the front and rear wheels 12 and 14 above and spaced from travel surface 22. The vehicle remains substantially horizontal as it jumps such that the vehicle usually lands upright.

Figure 5:
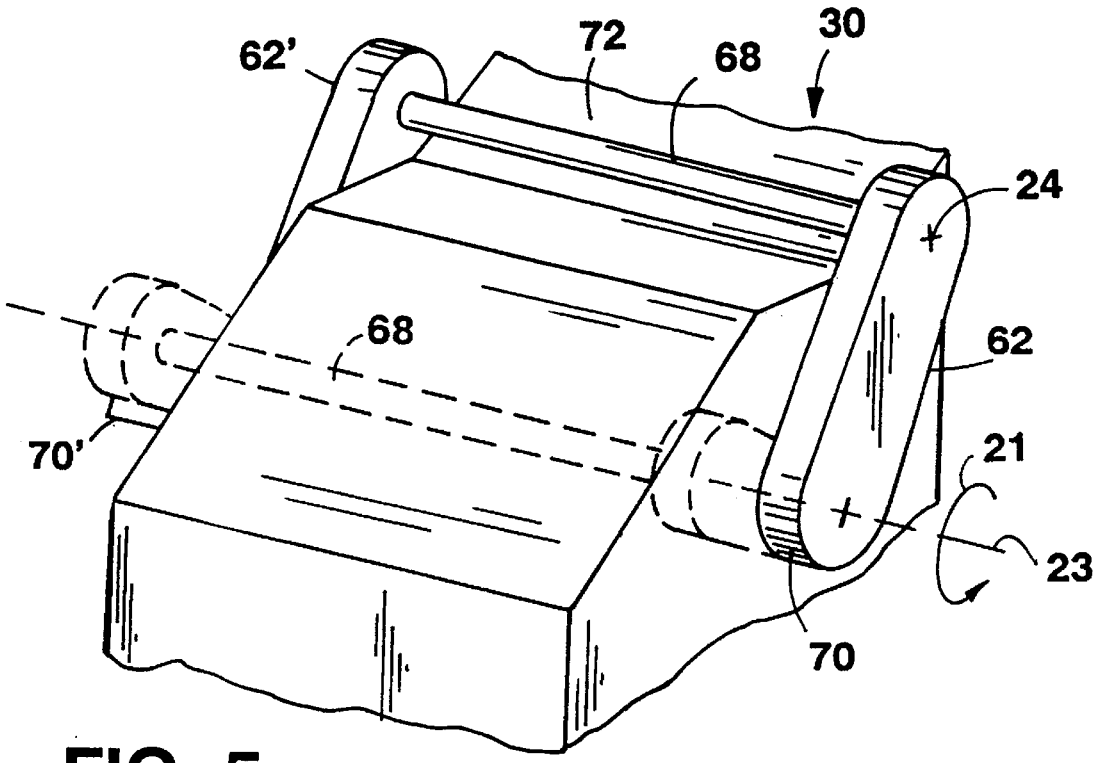
FIG. 5 is a portion of the underside of the jumping toy vehicle.

Referring to FIG. 4, there is shown an exploded view of the jumping mechanism. Jumping mechanism 50 includes a cam motor 52 mounted on vehicle chassis 54. Cam motor 52 drives a pinion gear 56 which contacts and drives sector gear 58. Sector gear 58 is mounted on a cam axle 60 which rotates therewith. A cam arm 62 is mounted on axle 60 for rotation therewith about axis 23 (see FIG. 1). Rotation of cam arm 62 is limited to typically about 75°, as described below with reference to FIG. 5 showing a portion of the vehicle underside. Cam 16 is eccentrically mounted on end 69 of cam arm 62 to freely pivot in the direction indicated by arrow 36 about axis 24 (see FIG. 1). The distance between axes 23 and is typically about 1 inch.

The rotation of cam arm 62 by motor 52 in the direction indicated by arrow 21, moves cam 16 from its at-rest position 30 to its initial ground contact position 32. As cam 16 begins to rotate about axis 24, cam arm 62 continues to rotate in the direction indicated by arrow 21 until end 69, connected to stop bar 68, of cam arm 62 hits stops 70 (see FIG. 5).

Figure 5A:
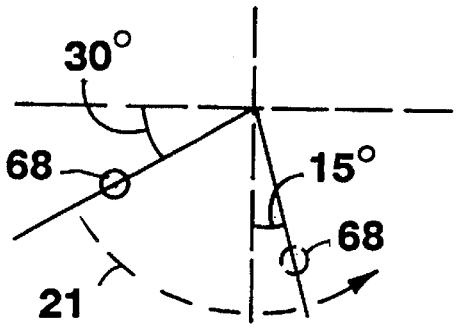
FIG. 5A is a representation of the travel of the stop bar.

Referring to FIG. 5A, there is shown a graphical representation of the travel of stop bar 68. The rotation of stop bar 68 is from about 30° counterclockwise from a horizontal axis to 15° counterclockwise from a vertical axis. In FIG. 5, stop bar 68 is shown in the at-rest position 30 (FIG. 1) where stop bar 68 contacts chassis surface 72, and, in broken lines, in the jumping position with arms 62 and 62' against stops 70 and 70'. Cams 16 and 16' will generally be between positions 32 and 38 (FIGS. 1 and 2) at the time arms 62 and 62' contact stops 70 and 70', respectively. With ends 69 and 69' against stops 70 and 70', the center of mass of vehicle 10 is preferably positioned vertically above axis 24.

Referring again to FIG. 4, a spring 66 running from sector gear 58 to chassis 54 biases cam arm 62 toward the direction indicated by arrow 67 to hold cam 16 in its at-rest position 30 when vehicle jumping is not desired. The contact of stop rod 68 against surface 72 (FIG. 5) when cam 16 is in its at-rest position acts against the force of spring 66 to prevent rotation of cam 16 in the direction indicated by arrow 67 past the cam's at-rest position. A second sector gear like 58, spring like 66 and cam arm like 62 are located on the right side of the vehicle for actuating the right cam 16'.

Figure 6:
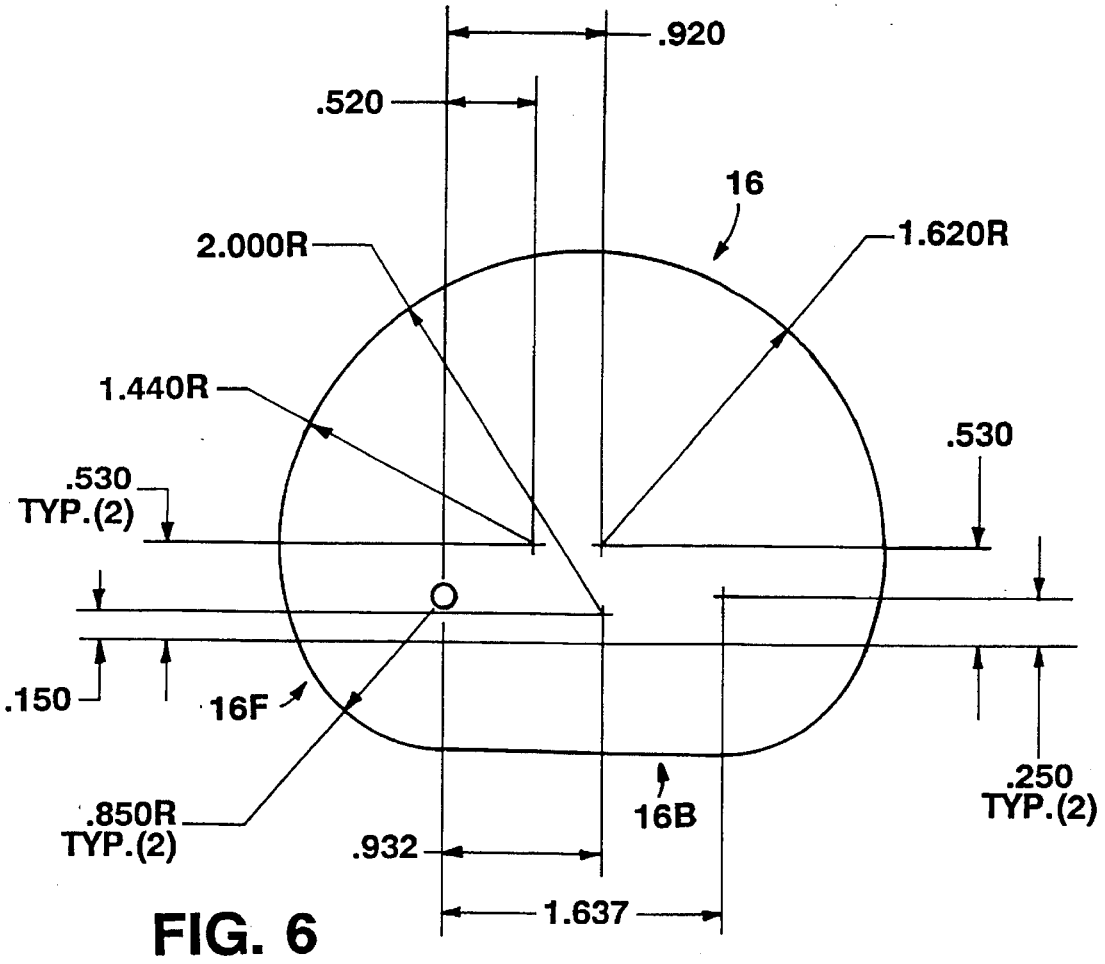
FIG. 6 is a side view of the left cam.

Referring to FIG. 6, during normal operation of the vehicle the cam elements are positioned with their flat bottom sides, such as 16B, facing downward, and, as a result, the cam elements do not interfere with the normal operation of the vehicle. However, actuation of motor 54 for just a fraction of a second to move ends 69 of cam arms 62 downward, moves cams 16 and 16' to position 32 (FIG. 1) with the curved front ends, such as 16F, of cams 16 and 16' engaging travel surface 22. Motor 52 may then be de-energized and the forward momentum of the vehicle continues the counterclockwise rotation of cams 16 and 16' about axis 24. Cams 16 and 16' lift the vehicle off travel surface 22 with enough force to cause the entire vehicle, including the cams, to leave surface 22. Spring 66 is a source of restoring force that returns cam arm 62 to its original position corresponding to at-rest position 30. Upon landing, cams 16 and 16' return to their at-rest position 30.

Cams 16 and 16' may be, for example, ABS with ribbing for strength. Rubber tire 26 may be, for example, a compression molded rubber having a durometer of about 50 shore A. Idle wheel 20 typically has a diameter of about ¾" and may be, for example, Delrin® plastic.

The derivative with respect to angle of cam radius (dr/du) is related to the height the vehicle jumps. Practical cam dimensions are related to the speed and mass of the vehicle. The slower the vehicle, the greater dr/du may be. If dr/du is too high, the vehicle may not jump forward enough to clear obstacles of a desired height. For a 2½ to 3 pound vehicle traveling about 15 mph, cams correspondingly to the structure shown in FIG. 6 typically cause the vehicle to jump about 10 to 15 inches high and about 3 to 5 feet forward.

Referring again to FIG. 6, there is shown a preferred profile of the cams with the strip entrapped setting forth specific dimensions in inches. The cam radii and profile are preferably selected to be compatible with the vehicle's weight, speed and center of gravity as related to the direction of performance. The radii and profile are selected to provide a jump that is high in both height and length while landing upright. The actual performance on a flat level surface is further contingent on the nature of the surface the cams engage at the time the remote radial jump command is given. Typical acceptable surfaces are concrete, carpet, asphalt and others. The cam strips durometer, material and size are selected to help the performance and life of the vehicle.

Figure 7:
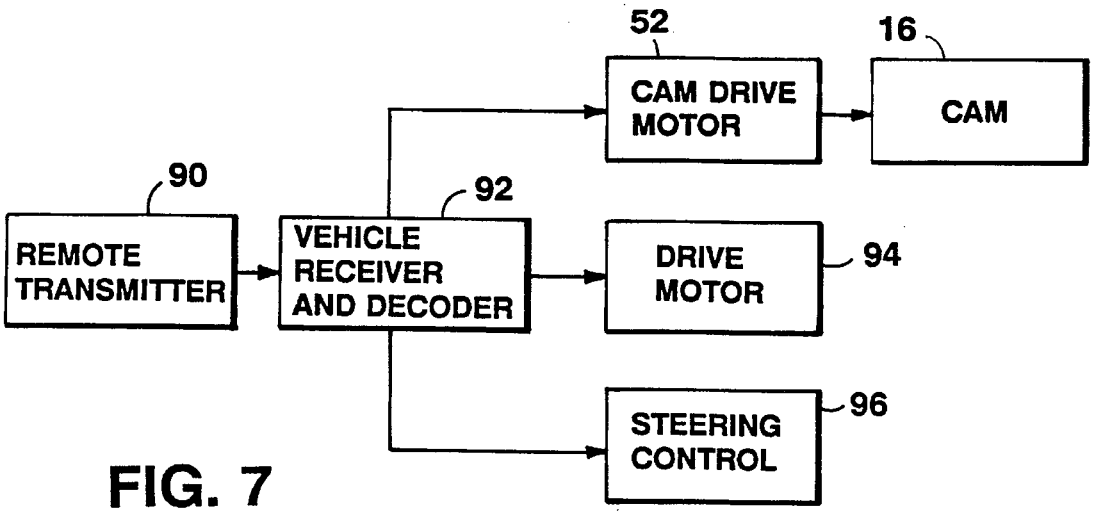
FIG. 7 is a block diagram illustrating the logical arrangement of a remotely controlled toy vehicle system embodying the invention.

Referring to FIG. 7, there is shown a block diagram of a remotely controlled toy vehicle embodying the invention. A remote transmitter 90 transmits control signals to a vehicle receiver and decoder 92 for controlling motor 94 that includes a source of electrical power, such as a battery. Steering can be done with steering motor 96, and cam drive motor 52. The jump signal cannot be acted upon by receiver and decoder 92 unless the vehicle is moving forward.

The invention takes advantage of converting the stored energy (momentum) of the vehicle in an upward and forward direction by releasing the cams. This release causes the center of gravity to follow the impetus (residual force) provided by the efficacy of the cam to propel the vehicle up and forward. Preferably, the decoder is arranged so that the cams descend only when the main drive motor allows the vehicle to move forward. The cams remain retracted when the vehicle is stationary or running in reverse.

A suitable cam motor is the Mabuchi #RC-280 RA-2485.

Figure 8A:
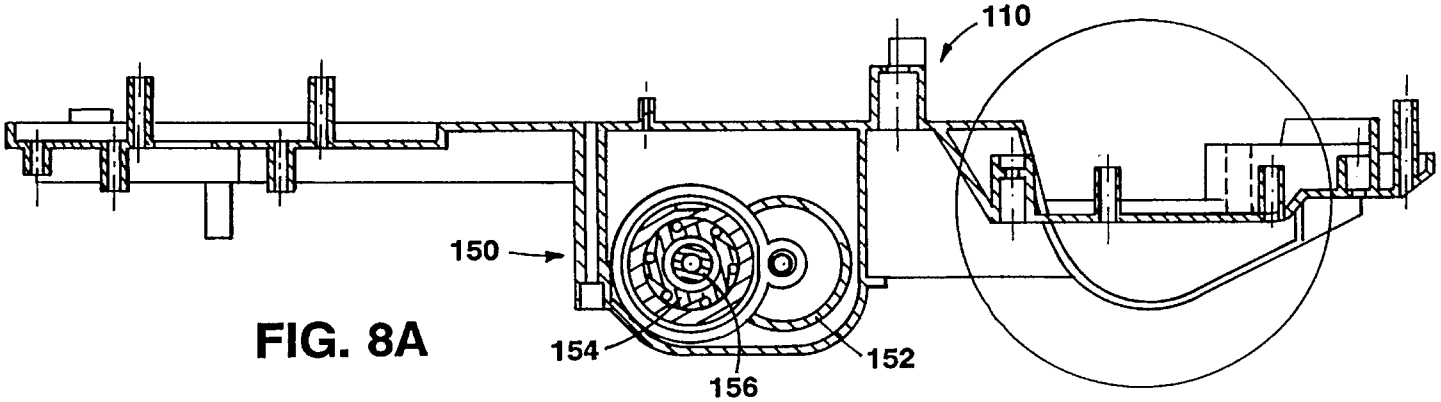
FIG. 8A is a side view showing an alternative embodiment of a jumping toy vehicle with jumping mechanism according to the invention.
Figure 8B:
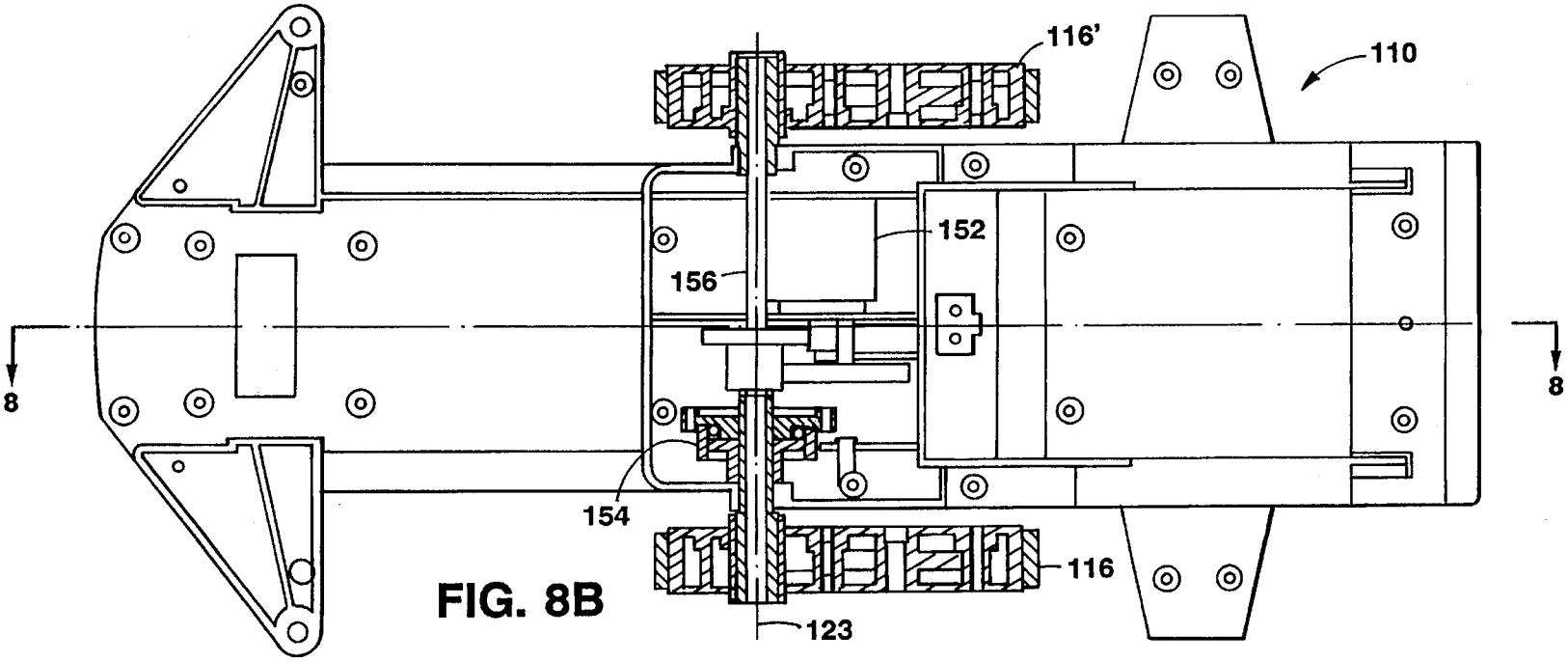
FIG. 8B is a bottom view of the alternative embodiment of FIG. 8.

Referring to FIGS. 8 and 8A there are shown side and bottom views respectively of an alternative embodiment of the invention. An alternative jumping mechanism 150 of a vehicle 110 includes a cam motor 152 driving a clutch 154 which only transfers drive power when rotating counterclockwise as viewed in FIG. 8 Left and right cams 116, 116', respectively, are mounted on a rod 156, driven by clutch 154, for rotation therewith about an axis 123. The axis of rotation 123 of rod 156 preferably corresponds to axis 23 of FIG. 1. Cams 116, 166' may have similar profiles to that of cam 16 of FIG. 6. In this embodiment of the invention, the cams only rotate about the one axis 123, i.e., there is no axis of rotation corresponding to axis 24 of FIG. 1.

Other embodiments are within the claims.

What is claimed is:

1. A remote controlled toy vehicle system comprising:

a remote transmitter controller for providing control signals, a vehicle having front and rear wheels for normally rollably supporting said vehicle on a travel surface coextensive with a bottom plane tangential to the bottommost portions of said wheels, said vehicle including a receiver and decoder responsive to said control signals for providing decoded control signals, cam structure mounted on said vehicle intermediate said front and rear wheels having at least one cam mounted on a cam axle constructed and arranged to have a first at-rest position with said cam entirely above said bottom plane and a second lift-initiating position with a significant portion of said cam below said bottom plane and said cam in contact with the travel surface with said front and rear wheels above and spaced from the travel surface and applying sufficient force to the travel surface to temporarily lift said front and rear wheels off the travel surface that causes said vehicle when moving to jump, said vehicle having a source of electrical power, and, at least one electrical motor mounted on said vehicle responsive to selected ones of said decoded control signals for receiving electrical power from said source of electrical power and actuating said cam structure from said first at-rest position to said second lift-initiating position.

2. The remote controlled toy vehicle system of claim 1 wherein said cam structure further includes at least one rotatably supported idle wheel for contacting a travel surface when said cam is in said first at-rest position.

3. The remote controlled toy vehicle system of claim 1 further including a cam axle intercoupling said motor and said cam structure.

4. The remote controlled toy vehicle system of claim 3 further including a cam arm, said cam arm having a first end connected to said cam axle and a second end connected to said cam structure.

5. The remote controlled toy vehicle system of claim 4 wherein said cam structure is pivotally connected to said second end for free rotation about a second end axis.

6. The remote controlled toy vehicle system of claim 3 further including a spring coupled to said cam axle for normally holding said cam structure in said first at-rest position.

7. The remote controlled toy vehicle system of claim 6 further including stop bar structure limiting the range of angular displacement of said cam axle between first and second predetermined limit angles.

8. The remote controlled toy vehicle system of claim 4 further including stop bar structure limiting the range of angular displacement of said cam axle between first and second predetermined limit angles.

9. The remote controlled toy vehicle system of claim 1 wherein said cam structure further includes circumferential strip structure for contacting a travel surface characterized by a coefficient of friction sufficiently high to prevent sliding movement between said travel surface and portions of said strip structure in contact therewith during rotation of said cam structure.

10. The remote controlled toy vehicle system of claim 1 wherein said cam structure includes a source of restoring force constructed and arranged to restore said cam structure to said at-rest position at the conclusion of a jump.

11. A remote controlled toy vehicle system in accordance with claim 1, and further comprising, at least a second electrical motor mounted on said vehicle responsive to selected ones of said decoded control signals for receiving electrical power from said source of said electrical power and driving said vehicle.

12. A toy vehicle comprising:

cam structure mounted on said vehicle having front and rear wheels for normally rollably supporting said vehicle on a travel surface coextensive with a bottom plane tangential to the bottommost portions of said wheels, said vehicle constructed and arranged to have a first at-rest position with said cam entirely above said bottom plane and a second lift-initiating position with a significant portion of said cam below said bottom plane and said cam in contact with the travel surface with said front and rear wheels above and spaced from the travel surface and applying sufficient force to the travel surface to temporarily lift said front and rear wheels off the travel surface that causes said vehicle when moving to jump, said vehicle having a source of electrical power, and at least one electrical motor mounted on said vehicle intermediate said front and rear wheels having at least one cam mounted on a cam axle for receiving electrical power from said source of electrical power and actuating said cam structure from said first at-rest position to said second lift-initiating position.

13. The toy vehicle of claim 12 wherein said cam structure further includes at least one rotatably supported idle wheel for contacting a travel surface when said cam is in said first at-rest position.

14. The toy vehicle of claim 12 further including a cam axle intercoupling said motor and said cam structure.

15. The toy vehicle of claim 14 further including a cam arm, said cam arm having a first end connected to said cam axle and a second end connected to said cam structure.

16. The toy vehicle of claim 15 wherein said cam structure is pivotally connected to said second end for free rotation about a second end axis.

17. The toy vehicle of claim 14 further including a spring coupled to said cam axle for normally holding said cam structure in said first at-rest position.

18. The toy vehicle of claim 17 further including stop bar structure limiting the range of angular displacement of said cam axle between first and second predetermined limit angles.

19. The toy vehicle of claim 15 further including stop bar structure limiting the range of angular displacement of said cam axle between first and second predetermined limit angles.

20. The toy vehicle of claim 12 wherein said cam structure further includes circumferential strip structure for contacting a travel surface characterized by a coefficient of friction sufficiently high to prevent sliding movement between said travel surface and portions of said strip structure in contact therewith during rotation of said cam structure.

21. The toy vehicle of claim 12 wherein said cam structure includes a source of restoring force constructed and arranged to restore said cam structure to said at rest position at the conclusion of a jump.

22. The toy vehicle in accordance with claim 12, and further comprising, at least a second electrical motor mounted on said vehicle responsive to selected ones of said decoded control signals for receiving electrical power from said source of said electrical power and driving said vehicle.

* * * * *